US009406302B2

(12) United States Patent
Taleb et al.

(10) Patent No.: US 9,406,302 B2
(45) Date of Patent: Aug. 2, 2016

(54) METHOD AND APPARATUS FOR PROCESSING A MULTI-CHANNEL AUDIO SIGNAL

(71) Applicant: Huawei Technologies Co., Ltd., Shenzhen, Guangdong (CN)

(72) Inventors: Anisse Taleb, Kista (SE); David Virette, Munich (DE); Liyun Pang, Munich (DE); Yue Lang, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 159 days.

(21) Appl. No.: 14/144,874

(22) Filed: Dec. 31, 2013

(65) Prior Publication Data

US 2014/0140516 A1 May 22, 2014

Related U.S. Application Data

(63) Continuation of application No. PCT/CN2011/077198, filed on Jul. 15, 2011.

(51) Int. Cl.

| | |
|---|---|
| ***G10L 19/008*** | (2013.01) |
| ***G10L 21/04*** | (2013.01) |
| *G10L 21/055* | (2013.01) |
| *G10L 19/16* | (2013.01) |

(52) U.S. Cl.

CPC ..... *G10L 19/008* (2013.01); *G10L 21/04* (2013.01); *G10L 19/167* (2013.01); *G10L 21/055* (2013.01)

(58) Field of Classification Search

None

See application file for complete search history.

(56) References Cited

U.S. PATENT DOCUMENTS

| | | | | |
|---|---|---|---|---|
| 7,647,229 | B2 | 1/2010 | Ojala et al. | |
| 2005/0137729 | A1* | 6/2005 | Sakurai | G10L 21/04 700/94 |
| 2006/0235680 | A1 | 10/2006 | Yamamoto et al. | |
| 2007/0094031 | A1* | 4/2007 | Chen | 704/267 |
| 2007/0177620 | A1 | 8/2007 | Ohmuro et al. | |
| 2007/0186145 | A1 | 8/2007 | Ojala et al. | |
| 2008/0097752 | A1 | 4/2008 | Nakamura et al. | |
| 2008/0114606 | A1* | 5/2008 | Ojala et al. | 704/500 |
| 2009/0192804 | A1* | 7/2009 | Schuijers et al. | 704/500 |
| 2010/0008556 | A1 | 1/2010 | Hirota et al. | |

(Continued)

FOREIGN PATENT DOCUMENTS

| | | | |
|---|---|---|---|
| CN | 1926824 | A | 3/2007 |
| CN | 101379556 | A | 3/2009 |
| CN | 102084418 | A | 6/2011 |

(Continued)

OTHER PUBLICATIONS

F. Baumgarte and C. Faller, "Binaural Cue COding. Part I: Psychoacoustic Fundamentals and Design Principles," IEEE Trans. Speech Audio Proc., 2003, accepted for publication.*

(Continued)

*Primary Examiner* — Curtis Kuntz
*Assistant Examiner* — Kenny Truong

(57) ABSTRACT

The invention relates to a method for processing a multi-channel audio signal which carries a plurality of audio channel signals. The method comprises determining a time-scaling position using the plurality of audio channel signals and time-scaling each audio channel signal of the plurality of audio channel signals according to the time-scaling position to obtain a plurality of time scaled audio channel signals.

19 Claims, 6 Drawing Sheets

(56) References Cited

U.S. PATENT DOCUMENTS

| | | | | |
|---|---|---|---|---|
| 2011/0103591 | A1 | 5/2011 | Ojala | |
| 2012/0300945 | A1 * | 11/2012 | Wu et al. | 381/17 |

FOREIGN PATENT DOCUMENTS

| | | | |
|---|---|---|---|
| JP | 2006-293230 | A | 10/2006 |
| JP | 2008107413 | A | 5/2008 |
| JP | 2010017216 | A | 1/2010 |
| WO | WO 2008/046967 | A1 | 4/2008 |

OTHER PUBLICATIONS

C. Faller and F. Baumgarte, "Binaural Cue Coding. Part II: Schemes and Applications," IEEE Trans. Speech Audio Proc., 2003, accepted for publication.*

Rishi Sinha, et al.,"Loss Concealment for Multi-Channel Streaming Audio", NOSSDAV'03, Jun. 1-3, 2003, p. 100-109.

Werner Verhelst, et al., "An Overlap-Add Technique Based on Waveform Similarity (WSOLA) for High Quality Time-Scale Modification of Speech", IEEE, 1993, p. II-554-II-557.

* cited by examiner

METHOD AND APPARATUS FOR PROCESSING A MULTI-CHANNEL AUDIO SIGNAL

CROSS-REFERENCE TO RELATED APPLICATIONS

This application is a continuation of International Application No. PCT/CN2011/077198, filed on Jul. 15, 2011, which is hereby incorporated by reference in its entirety.

TECHNICAL FIELD

The present invention relates to a method and an apparatus for processing a multi-channel audio-signal.

BACKGROUND

Time-scaling algorithms change the duration of an audio signal while retaining the signals local frequency content, resulting in the overall effect of speeding up or slowing down the perceived playback rate of a recorded audio signal without affecting the pitch or timbre of the original signal. In other words, the duration of the original signal is increased or decreased but the perceptually important features of the original signal remain unchanged; for the case of speech, the time-scaled signal sounds as if the original speaker has spoken at a quicker or slower rate; for the case of music, the time-scaled signal sounds as if the musicians have played at a different tempo. Time-scaling algorithms can be used for adaptive jitter buffer management (JBM) in VoIP applications or audio/video broadcast, audio/video postproduction synchronization and multi-track audio recording and mixing.

In voice over IP applications, the speech signal is first compressed using a speech encoder. In order to maintain the interoperability, voice over IP systems are usually built on top of open speech codecs. Such systems can be standardized, for instance in ITU-T or 3GPP codec (several standardized speech codec are used for VoIP: G.711, G.722, G.729, G.723.1, AMR-WB) or have a proprietary format (Speex, Silk, CELT). The encoded speech signal is packetized and transmitted in IP packets.

Packets will encounter variable network delays in VoIP, so the packets arrive at irregular intervals. In order to smooth such jitter, a jitter buffer management mechanism is usually required at the receiver, where the received packets are buffered for a while and played out sequentially at scheduled time. If the play-out time can be adjusted for each packet, then time scale modification may be required to ensure continuous play-out of voice data at the sound card.

As the delay is not a constant delay, time-scaling algorithms are used to stretch or compress the duration of a given received packet. In case of multi-channel VoIP applications including a jitter buffer management mechanism, in particular when the multi-channel audio codec is based on a mono codec which operates in dual/multi mono mode, i.e. one mono encoder/decoder is used for each channel, using an independent application of the time-scaling algorithm for each channel can lead to quality degradation, especially of the spatial sound image as the independent time-scaling will not guarantee that the spatial cues are preserved. In the audio/video broadcast and post-production application, time-scaling each channel separately may keep the synchronization between video and audio, but cannot guarantee the spatial cues are the same as the original one. The most important spatial cues for the spatial perception are the energy differences between channels, the time or phase differences between channels and the coherence or correlation between channels. As the time-scaling algorithms operate stretching and compression operation of the audio signal, the energy, delay and coherence between the time scaled channels may differ from the original ones.

SUMMARY

It is the object of the invention to provide a concept for jitter buffer management in multi-channel audio applications which preserves the spatial perception.

This object is achieved by the features of the independent claims. Further implementation forms are apparent from the dependent claims, the description and the figures.

The invention is based on the finding that preserving spatial cues of multi-channel audio signals during the multi-channel time-scaling processing preserves the spatial perception. Spatial cues are spatial information of multi-channel signals, such as Inter-channel Time Differences (ITD), Inter-channel Level Differences (ILD), Inter-Channel Coherence/Inter-channel Cross Correlation (ICC) and others.

In order to describe the invention in detail, the following terms, abbreviations and notations will be used:

ITD: Inter-Channel Time Difference,
ILD: Inter-Channel Level Difference,
ICC: Inter-Channel Coherence,
IC: Inter-Channel Cross Correlation,
Cross-AMDF: Cross Average Magnitude Difference Function,
WSOLA: Waveform-similarity-based Synchronized Overlap-Add,
IP: Internet Protocol,
VoIP: Voice over Internet Protocol.

According to a first aspect, the invention relates to a method for processing a multi-channel audio signal, the multi-channel audio signal carrying a plurality of audio channel signals, the method comprising: determining a time-scaling position using the plurality of audio channel signals; and time-scaling each audio channel signal of the plurality of audio channel signals according to the time-scaling position to obtain a plurality of time scaled audio channel signals.

The time-scaling position allows to synchronize the different audio channel signals in order to preserve the spatial information. In case of multi-channel VoIP applications including a jitter buffer management mechanism, when the multi-channel audio codec is based on a mono codec which operates in dual/multi mono mode, i.e. one mono encoder/decoder is used for each channel, using an independent application of the time-scaling algorithm for each channel will not lead to quality degradation as the time-scaling for each channel is synchronized by the time-scaling position such that the spatial cue and thereby the spatial sound image is preserved. The user has a significant better perception of the multi-channel audio signal.

In audio/video broadcast and post-production applications, time-scaling each channel separately with a common time scaling position keeps the synchronization between video and audio and guarantees that the spatial cues do not change.

The most important spatial cues for the spatial perception are the energy differences between channels, the time or phase differences between channels and the coherence or correlation between channels. By determining the time-scaling position, these cues are preserved and do not differ from the original ones. The user perception is improved.

In a first possible implementation form of the method according to the first aspect, the method comprises: extracting a first set of spatial cue parameters from the plurality of audio channel signals, the first set of spatial cue parameters relating to a difference measure of a difference between the plurality of audio channel signals and a reference audio channel signal derived from at least one of the plurality of audio channel signals; extracting a second set of spatial cue parameters from the plurality of time scaled audio channel signals, the second set of spatial cue parameters relating to the same type of difference measure as the first set of spatial cue parameters relates to, wherein the second set of spatial cue parameters relates to a difference between the plurality of time scaled audio channel signals and a reference time scaled audio channel signal derived from at least one of the plurality of time scaled audio channel signals; and determining whether the second set of spatial cue parameters fulfills with regard to the first set of spatial cue parameters a quality criterion.

The difference measure may be one of a cross-correlation (cc), a normalized cross-correlation (cn) and a cross average magnitude difference function (ca) as defined by the equations (5), (1), (8) and (6) and described below with respect to FIG. 2. The quality criterion may be an optimization criterion. It may be based on a similarity between the second set of spatial cue parameters and the first set of spatial cue parameters. The reference signal can be, e.g., one of the audio channel signals or a down-mix signal derived from some or all of the plurality of audio channel signals. The same applies to the time scaled audio channel signals.

In a second possible implementation form of the method according to the first implementation form of the first aspect, the extraction of a spatial cue parameter of the first set of spatial cue parameters comprises correlating an audio channel signal of the plurality of audio channel signals with the reference audio channel signal; and the extracting of a spatial cue parameter of the second set of spatial cue parameters comprises correlating a time scaled audio channel signal of the plurality of the time scaled audio channel signals with the reference time scaled audio channel signal.

The reference audio channel signal may be one of the plurality of audio channel signals which shows similar behavior with respect to its spectral components, its energy and its speech sound as the other audio channel signals. The reference audio channel signal may be a mono down-mix signal, which may be computed as the average of all the M channels. The advantage of using a down-mix signal as a reference for a multi-channel audio signal is to avoid using a silent signal as reference signal. Indeed the down-mix represents an average of the energy of all the channels and is hence less subject to be silent. Similarly, the time scaled audio channel signal may be one of the plurality of time scaled audio channel signals showing similar behavior with respect to its spectral components, its energy and its speech sound as the other time-scaled audio channel signals. The reference time-scaled audio channel signal may be a mono down-mix signal, which is the average of all the M time-scaled channels and is hence less subject to be silent.

In a third possible implementation form of the method according to the first or the second implementation forms of the first aspect, the method comprises the following steps if the extracted second set of spatial cue parameters does not fulfill the quality criterion: time-scaling each audio channel signal of the plurality of audio channel signals according to a further time-scaling position to obtain a further plurality of time scaled audio channel signals, wherein the further time-scaling position is determined using the plurality of audio channel signals; extracting a third set of spatial cue parameters from the further plurality of time scaled audio channel signals, the third set of spatial cue parameters relating to the same type of difference measure as the first set of spatial cue parameters relates to, wherein the third set of spatial cue parameters relates to a difference between the further plurality of time scaled audio channel signals and a further reference time scaled audio channel signal derived from at least one of the further plurality of time scaled audio channel signals; determining whether the third set of spatial cue parameters fulfills with regard to the first set of spatial cue parameters the quality criterion; and outputting the further plurality of time scaled audio channel signals if the third set of spatial cue parameters fulfills the quality criterion.

The quality criterion can be restrictive thereby delivering the set of spatial cue parameters of high quality.

In a fourth possible implementation form of the method according to any of the preceding implementation forms of the first aspect, the respective set of spatial cue parameters fulfils with regard to the first set of spatial cue parameters the quality criterion if the respective set of spatial cue parameters is within a spatial cue parameter range. By the spatial cue parameter range the user may control the level of quality to be delivered by the method. The range may be successively enlarged if no respective sets of spatial cue parameters are found fulfilling the quality criterion. Not only one spatial cue parameter but the complete set has to be within the parameter range.

In a fifth possible implementation form of the method according to the first aspect as such or according to any of the previous implementation forms of the first aspect, the respective set of spatial cue parameters comprises one of the following parameters: an Inter Channel Time Difference (ITD), an Inter Channel Level Differences (ILD), an Inter Channel Coherence (ICC), and an Inter Channel Cross Correlation (IC). Definitions for these parameters are given by equation (11) for ILD, equation (12) for ITD and equation (13) for IC and ICC, as described below with respect to FIG. 2.

In a sixth possible implementation form of the method according to the first aspect as such or according to any of the previous implementation forms of the first aspect, the determining the time-scaling position comprises: for each of the plurality of audio channel signals, determining a channel cross-correlation function having candidate time-scaling positions as parameter; determining a cumulated cross-correlation function by cumulating the plurality of channel cross-correlation functions depending on the candidate time-scaling positions; selecting the time-scaling position which is associated with the greatest cumulated cross-correlation value of the cumulated cross-correlation function to obtain the time-scaling position.

If no time-scaling position is found that fulfills the quality criterion, the time-scaling position with the maximum cross-correlation (cc), normalized cross-correlation (cn) or cross average magnitude difference function (ca) may be chosen. At least an inferior time-scaling position can be found in any case. A further time-scaling position may be selected which is associated with the second greatest cumulated cross-correlation value. Further time-scaling positions may be selected which are associated with third, fourth, on so on greatest cumulated cross-correlation values.

In a seventh possible implementation form of the method according to the sixth implementation form of the first aspect, the respective cross-correlation function is one of the following cross-correlation functions: a Cross-correlation function, a Normalized cross-correlation function, and a Cross Average Magnitude Difference Function (Cross-AMDF). These functions are given by equations (2), (3) and (4) described with respect to FIG. 2.

In an eighth possible implementation form of the method according to the sixth or seventh implementation forms of the first aspect, the method further comprises: for each audio channel signal of the plurality of audio channel signals, determining a weighting factor from a spatial cue parameter, wherein the spatial cue parameter is extracted based on the audio channel signal and a reference audio channel signal derived from at least one of the plurality of audio channel signals, and wherein the spatial cue parameter is in particular an Inter Channel Level Difference; and individually weighting each channel cross-correlation function with the weighting factor determined for the audio channel signal.

The calculation of the weighting factor is as defined in equation (7) and alternatively in equation (9) as described with respect to FIG. 2.

The weighting factor is determined from a spatial cue parameter which can be a spatial cue parameter of the first set of spatial cue parameters or at least from the same type, but it can also be of another type of spatial cue parameters. For instance, the first set uses ITD as spatial cue parameter, but the weighting factor is based on ILD.

In a ninth possible implementation form of the method according to the first aspect as such or according to any of the previous implementation forms of the first aspect, the method further comprises buffering the plurality of audio channel signals prior to time-scaling each audio channel signal of the plurality of audio channel signals. The buffer can be a memory cell, a RAM or any other physical memory. The buffer can be the jitter buffer as described below with respect to FIG. 5.

In a tenth possible implementation form of the method according to the first aspect as such or according to any of the previous implementation forms of the first aspect, the time-scaling comprises overlapping and adding audio channel signal portions of the same audio channel signal. The overlapping and adding can be part of a Waveform-similarity-based Synchronized Overlap-Add (WSOLA) algorithm.

In an eleventh possible implementation form of the method according to the first aspect as such or according to any of the previous implementation forms of the first aspect, the multi-channel audio signal comprises a plurality of encoded audio channel signals, and the method comprises: decoding the plurality of encoded audio channel signals to obtain the plurality of audio channel signals.

The decoder is used for decompressing the multi-channel audio signal which may be a speech signal. The decoder may be a standard decoder in order to maintain the interoperability with voice over IP systems. The decoder may utilize an open speech codec, for instance a standardized ITU-T or 3GPP codec. The codec of the decoder may implement one of the standardized formats for VoIP which are G.711, G.722, G.729, G.723.1 and AMR-WB or one of the proprietary formats which are Speex, Silk and CELT. The encoded speech signal is packetized and transmitted in IP packets. This guarantees interoperability with standard VoIP applications used in the field.

In a twelfth possible implementation form of the method according to the eleventh implementation form of the first aspect, the method further comprises: receiving a single audio signal packet; and extracting the plurality of encoded audio channels from the received single audio signal packet. The multi-channel audio signal can be packetized within a single IP packet such that the same jitter is experienced by each of the audio channel signals. This helps maintaining quality of service (QoS) for a multi-channel audio signal.

In a thirteenth possible implementation form of the method according to the eleventh implementation form of the first aspect, the method further comprises: receiving a plurality of audio signal packets, each audio signal packet comprising an encoded audio channel of the plurality of separately encoded audio channels, and a channel index indicating the respective encoded audio channel; extracting the plurality of encoded audio channels from the received plurality of audio signal packets; and aligning the plurality of encoded audio channels upon the basis of the received channel indices.

By the channel indices, a time position of the respective encoded audio channel within the encoded multi-channel audio signal can be provided to the receiver such that a jitter buffer control mechanism within the receiver may reconstruct the exact position of the respective channel. In cases where the audio signal frames are differently transmitted over the network and thereby experiencing different delays, the jitter buffer mechanism may compensate for the delays of the different transmission paths. Such jitter buffer mechanism is implemented in a jitter buffer management device as described below with respect to FIG. 5.

According to a second aspect, the invention relates to an audio signal processing apparatus for processing a multi-channel audio signal, the multi-channel audio signal comprising a plurality of audio channel signals, the audio signal processing apparatus comprising: a determiner adapted to determine a time-scaling position using the plurality of audio channel signals; and a time scaler adapted to time scale each audio channel signal of the plurality of audio channel signals according to the time-scaling position to obtain a plurality of time scaled audio channel signals.

The time-scaling position allows to synchronize the different audio channel signals in order to preserve the spatial information. In case of multi-channel VoIP application including a jitter buffer management mechanism, when the multi-channel audio codec is based on a mono codec which operates in dual/multi mono mode, i.e. one mono encoder/decoder is used for each channel, using an independent application of the time-scaling algorithm for each channel with a common time-scaling position will not lead to quality degradation as the time-scaling for each channel is synchronized by the time-scaling position such that the spatial cue and thereby the spatial sound image is preserved. The user has a significantly better perception of the multi-channel audio signal.

In the audio/video broadcast and post-production application, time-scaling each channel separately with a common time-scaling position keeps the synchronization between video and audio and guarantees that the spatial cue does not change. The most important spatial cues for the spatial perception are the energy differences between channels, the time or phase differences between channels and the coherence or correlation between channels. By determining the time-scaling position, these cues are preserved and do not differ from the original ones. The user perception is improved.

In a first possible implementation form of the audio signal processing apparatus according to the second aspect, the multi-channel audio signal comprises a plurality of encoded audio channel signals, and the audio signal processing apparatus comprises: a decoder adapted to decode the plurality of encoded audio channel signals to obtain the plurality of audio channel signals.

The decoder may also be implemented outside the audio signal processing apparatus as described below with respect to FIG. 5. The decoder may be a standard decoder in order to maintain the interoperability with voice over IP systems. The decoder may utilize an open speech codec, for instance a standardized ITU-T or 3GPP codec. The codec of the decoder may implement one of the standardized formats for VoIP which are G.711, G.722, G.729, G.723.1 and AMR-WB or one of the proprietary formats which are Speex, Silk and CELT. The encoded speech signal is packetized and transmitted in IP packets. This guarantees interoperability with standard VoIP applications used in the field.

In an second possible implementation form of the audio-signal processing apparatus according to the second aspect as such or according to the first implementation form of the second aspect, the audio signal processing apparatus comprises: an extractor adapted to extract a first set of spatial cue parameters from the plurality of audio channel signals, the first set of spatial cue parameters relating to a difference measure of a difference between the plurality of audio channel signals and a reference audio channel signal derived from at least one of the plurality of audio channel signals, wherein the extractor is further adapted to extract a second set of spatial cue parameters from the plurality of time scaled audio channel signals, the second set of spatial cue parameters relating to the same type of difference measure as the first set of spatial cue parameters relates to, wherein the second set of spatial cue parameters relates to a difference between the plurality of time scaled audio channel signals and a reference time scaled audio channel signal derived from at least one of the plurality of time scaled audio channel signals; and a processor adapted determine whether the second set of spatial cue parameters fulfills with regard to the first set of spatial cue parameters a quality criterion.

The difference measure may be one of a cross-correlation (cc), a normalized cross-correlation (cn) and a cross average magnitude difference function (ca) as defined by the equations (1), (5), (6) and (8) described below with respect to FIG. 2. The quality criterion may be an optimization criterion. It may be based on a similarity between the second set of spatial cue parameters and the first set of spatial cue parameters.

The reference audio channel signal may be one of the plurality of audio channel signals which shows similar behavior with respect to its spectral components, its energy and its speech sound as the other audio channel signals. The reference audio channel signal may be a mono down-mix signal, which is the average of all the M channels. The advantage of using a down-mix signal as a reference for a multi-channel audio signal is to avoid using a silent signal as reference signal. Indeed the down-mix represents an average of the energy of all the channels and is hence less subject to be silent. Similarly, the time scaled audio channel signal may be one of the plurality of time scaled audio channel signals showing similar behaviour with respect to its spectral components, its energy and its speech sound as the other time-scaled audio channel signals. The reference time-scaled audio channel signal may be a mono down-mix signal, which is the average of all the M time-scaled channels and is hence less subject to be silent.

In an third possible implementation form of the audio-signal processing apparatus according to the second aspect as such or according to any of the previous implementation forms of the second aspect, the determiner is adapted for each of the plurality of audio channel signals, to determine a channel cross-correlation function in dependency on candidate time-scaling positions, to determine a cumulated cross-correlation function by cumulating the plurality of channel cross-correlation functions depending on the candidate time-scaling positions, and to select the time-scaling position which is associated with the greatest cumulated cross-correlation value of the cumulated cross-correlation function to obtain the time-scaling position.

If no time-scaling position is found that fulfills the quality criterion, the time-scaling position with the maximum cross-correlation (cc), normalized cross-correlation (cn) or cross average magnitude difference function (ca) may be chosen. At least an inferior time-scaling position can be found in any case.

According to a third aspect, the invention relates to a programmably arranged audio signal processing apparatus for processing a multi-channel audio signal, the multi-channel audio signal comprising a plurality of audio channel signals, the programmably arranged audio signal processing apparatus comprising a processor being configured to execute a computer program for performing the method according to the first aspect as such or according to any of the implementation forms of the first aspect.

The programmably arranged audio signal processing apparatus comprises according to a first possible implementation form of the third aspect software or firmware running on the processor and can be flexibly used in different environments. If an error is found or better algorithms or parameters of an algorithm are found, the software can be reprogrammed or the firmware can be reloaded on the processor in order to improve the performance of the audio signal processing apparatus. The programmably arranged audio signal processing apparatus can be early installed in the field and re-programmed or reloaded in case of problems, thereby accelerating times to market and improving the installed base of telecommunications operators.

The invention can be implemented in digital electronic circuitry, or in computer hardware, firmware, software, or in combinations thereof.

BRIEF DESCRIPTION OF THE DRAWINGS

Further embodiments of the invention will be described with respect to the following figures, in which.

DETAILED DESCRIPTION

Figure 1:
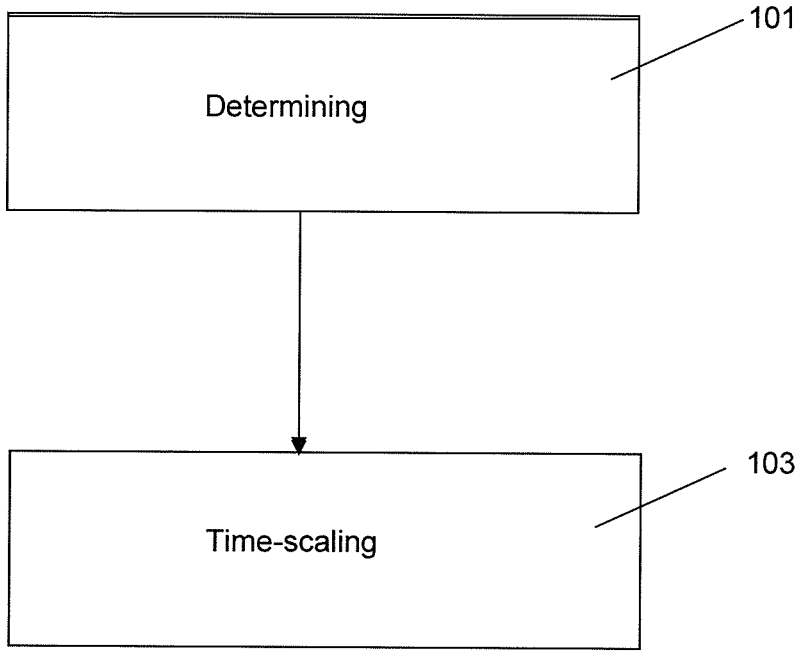
FIG. 1 shows a block diagram of a method for processing a multi-channel audio signal according to an implementation form.

FIG. 1 shows a block diagram of a method for processing a multi-channel audio signal which carries a plurality of audio channel signals according to an implementation form. The method comprises determining 101 a time-scaling position using the plurality of audio channel signals and time-scaling 103 each audio channel signal of the plurality of audio channel signals according to the time-scaling position to obtain a plurality of time scaled audio channel signals.

Figure 2:
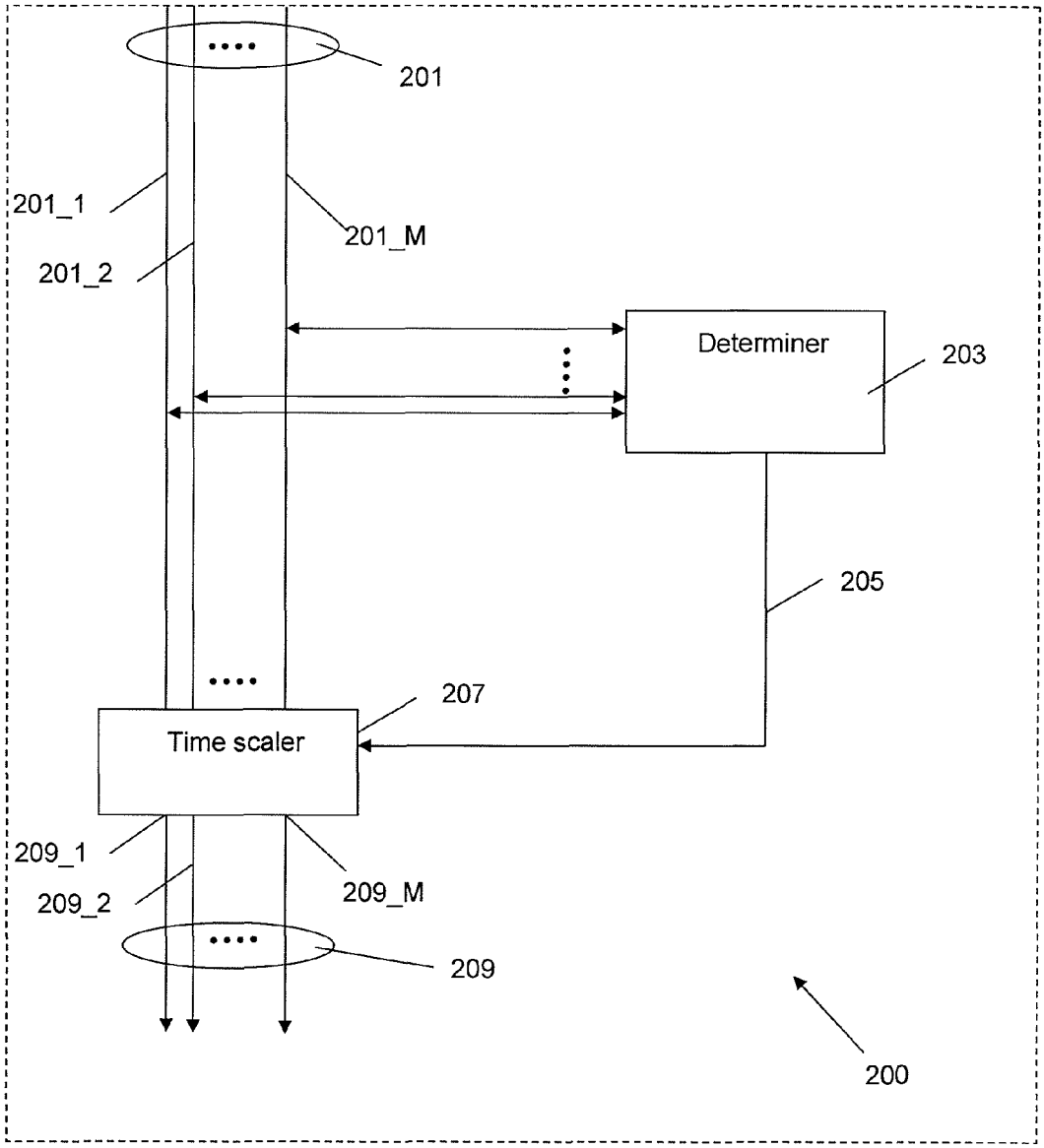
FIG. 2 shows a block diagram of an audio signal processing apparatus according to an implementation form.

FIG. 2 shows a block diagram of an audio signal processing apparatus 200 for processing a multi-channel audio signal 201 which comprises a plurality of M audio channel signals 201_1, 201_2, . . . , 201_M according to an implementation form. The audio signal processing apparatus 200 comprises a determiner 203 and a time scaler 207. The determiner 203 is configured to determine a time-scaling position 205 using the plurality of audio channel signals 201_1, 201_2, . . . , 201_M.

The time scaler 207 is configured to time-scale each audio channel signal of the plurality of audio channel signals 201_1, 201_2, . . . , 201_M according to the time-scaling position 205 to obtain a plurality of time scaled audio channel signals 209_1, 209_2, . . . , 209_M which constitute a time scaled multi-channel audio signal 209. The determiner 203 has M inputs for receiving the plurality of M audio channel signals 201_1, 201_2, . . . , 201_M and one output for providing the time-scaling position 205. The time scaler 207 has M inputs for receiving the plurality of M audio channel signals 201_1, 201_2, . . . , 201_M and one input to receive the time-scaling position 205. The time scaler 207 has M outputs for providing the plurality of M time scaled audio channel signals 209_1, 209_2, . . . 209_M which constitute the time scaled multi-channel audio signal 209.

In a first implementation form of the audio signal processing apparatus 200, the determiner 203 is configured to determine a time-scaling position 205 by computing the time scaling position δ from the multi-channel audio signal 201.

The determiner 203 calculates cross-correlation cc(m, δ), normalized cross-correlation cn(m, δ) and/or cross average magnitude difference functions (cross-AMDF) ca(m, δ) as follows:

$$cc(m,\delta)=cc_1(m,\delta)+cc_2(m,\delta)+\ldots+cc_M(m,\delta)$$

$$cn(m,\delta)=cn_1(m,\delta)+cn_2(m,\delta)+\ldots+cn_M(m,\delta)$$

$$ca(m,\delta)=ca_1(m,\delta)+ca_2(m,\delta)+\ldots+ca_M(m,\delta) \quad (1)$$

and determines the time-scaling positions δ for each channel 1 thru M which maximize the cc(m, δ), cn(m, δ) or ca(m, δ).

Cross-correlation cc(m, δ), normalized cross-correlation cn(m, δ) and cross average magnitude difference functions (cross-AMDF) ca(m, δ) are similarity measures which are determined as follows:

$$cc(m,\delta)=\sum_{n=0}^{N-1} x(n+\tau^{-1}((m-1)\cdot L)+\Delta_{m-1}+L)\cdot x(n+\tau^{-1}(m\cdot L)+\delta) \quad (2)$$

$$cc(m,\delta)=\frac{cc(m,\delta)}{\left(\sum_{n=0}^{N-1} x^2(\tau^{-1}(m*L)+\delta)\right)^{1/2}} \quad (3)$$

$$ca(m,\delta)=\sum_{n=0}^{N-1} |x(n+\tau^{-1}((m-1)\cdot L)+\Delta_{m-1}+L)-x(n+\tau^{-1}(m\cdot L)+\delta)|, \quad (4)$$

wherein the best segment m is determined by finding the value $\delta=\Delta_m$ that lies within a tolerance region $[-\Delta_{max}, \Delta_{max}]$ around a time interval $\tau^{-1}(m\cdot L)$, and maximizes the chosen similarity measure, N represents the window length of the cross-correlation function, m is the segment index, n is the sample index, cc, cn and ca are the abbreviations for cross-correlation, normalized cross-correlation and cross-AMDF, respectively, and δ represents the time-scaling position candidates.

The time scaler 207 time-scales each of the M audio channel signals 201_1, 201_2, . . . , 201_M with the corresponding time-scaling position δ, 205 determined by the determiner 203 to obtain the M time scaled audio channel signals 209_1, 209_2, . . . , 209_M constituting the time-scaled multi-channel audio signal 209.

In a second implementation form of the audio signal processing apparatus 200, the multi-channel audio signal 201 is a 2-channel stereo audio signal which comprises left and right audio channel signals 201_1 and 201_2. The determiner 203 is configured to determine a time-scaling position δ, 205 by computing the cross-correlation function from the stereo audio signal 201.

The determiner 203 calculates cross-correlation cc(m, δ), normalized cross-correlation cn(m, δ) and/or cross average magnitude difference functions (cross-AMDF) ca(m, δ) as follows:

$$cc(m,\delta)=cc_l(m,\delta)+cc_r(m,\delta)$$

$$cn(m,\delta)=cn_l(m,\delta)+cn_r(m,\delta)$$

$$ca(m,\delta)=ca_l(m,\delta)+ca_r(m,\delta) \quad (5)$$

where l and r are the abbreviation for left and right channel, m is the segment index, and determines the time-scaling positions δ for left and right channel which maximize the cc(m, δ), cn(m, δ) or ca(m, δ).

Cross-correlation cc(m, δ), normalized cross-correlation cn(m, δ) and cross average magnitude difference functions (cross-AMDF) ca(m, δ) are similarity measures which are determined as described above with respect to the first implementation form.

The time scaler 207 time-scales left and right audio channel signals 201_1 and 201_2 with the corresponding time-scaling position δ, 205 determined by the determiner 203 to obtain the left and right time scaled audio channel signals 209_1 and 209_2 constituting the time-scaled 2-channel stereo audio signal 209.

In a third implementation form of the audio signal processing apparatus 200, the determiner 203 is configured to determine a time-scaling position δ 205 from the multi-channel audio signal 201.

The determiner 203 calculates cross-correlation cc(m, δ) normalized cross-correlation cn(m, δ) and/or cross average magnitude difference functions (cross-AMDF) ca(m, δ) as follows:

$$cc(m,\delta)=w_1\cdot cc_1(m,\delta)+w_2+cc_2(m,\delta)+\ldots+w_M\cdot cc_M(m,\delta)$$

$$cn(m,\delta)=w_1\cdot cn_1(m,\delta)+w_2+cn_2(m,\delta)+\ldots+w_M\cdot cn_M(m,\delta)$$

$$ca(m,\delta)=w_1\cdot ca_1(m,\delta)+w_2+ca_2(m,\delta)+\ldots+w_M\cdot ca_M(m,\delta), \quad (6)$$

wherein the energy weightings $w_i$ are computed directly from the multi-channel audio signal 201 by using equation (7):

$$w_i=\Sigma_{n=0}^{N} x_i(n)\cdot x_i(n) \quad (7),$$

where $x_i(n)$ are the M audio channel signals 201_1, 201_2, . . . , 201_M in time domain. N is the frame length, n is the sample index.

The determiner 203 determines the time-scaling positions δ for each channel 1 thru M which maximize the cc(m, δ), cn(m, δ) or ca(m, δ) as described above with respect to the first implementation form.

The time scaler 207 time-scales each of the M audio channel signals 201_1, 201_2, . . . , 201_M with the corresponding time-scaling position δ, 205 determined by the determiner 203 to obtain the M time scaled audio channel signals 209_1, 209_2, . . . , 209_M constituting the time-scaled multi-channel audio signal 209.

In a fourth implementation form of the audio signal processing apparatus 200, the multi-channel audio signal 201 is a 2-channel stereo audio signal which comprises left and right audio channel signals 201_1 and 201_2. The determiner 203 is configured to determine a time-scaling position δ, 205 from the stereo audio signal 201.

The determiner 203 calculates cross-correlation cc(m, δ), normalized cross-correlation cn(m, δ) and/or cross average magnitude difference functions (cross-AMDF) ca(m, δ) as follows:

$$cc(m,\delta)=w_l\cdot cc_l(m,\delta)+w_r\cdot cc_r(m,\delta)$$

$$cn(m,\delta)=w_l\cdot cn_l(m,\delta)+w_r\cdot cn_r(m,\delta)$$

$$ca(m,\delta)=w_l\cdot ca_l(m,\delta)+w_r\cdot ca_r(m,\delta). \quad (8)$$

The left and right channel cross-correlations $cc_l(m, \delta)$ and $cc_r(m, \delta)$, the left and right channel normalized cross-correlations $cn_l(m, \delta)$ and $cn_r(m, \delta)$ and the left and right channel cross average magnitude difference functions (cross-AMDF) $ca_l(m, \delta)$ and $ca_r(m, \delta)$ are similarity measures which are determined as described above with respect to the first implementation form, wherein the calculation is based on signal values of the left and right channel. The energy weightings $w_l$ and $w_r$ correspond to left channel l and right channel r and are computed from ILD spatial parameters by using equation (9):

$$W_1 = \frac{c}{c+1},\ W_r = \frac{1}{c+1} \quad (9)$$

where $$c = 10^{ILD/20} \quad (10)$$

One of these two channels is taken as the reference channel providing the reference signal. The ILD is calculated from equation (11) as follows:

$$ILD_i[b] = 10\log_{10}\frac{\sum_{k=k_b}^{k_{b+1}-1} X_{ref}[k]X_{ref}^*[k]}{\sum_{k=k_b}^{k_{b+1}-1} X_i[k]X_i^*[k]} \quad (11)$$

where k is the index of frequency bin, b is the index of frequency band, $k_b$ is the start bin of band b, $k_{b+1}-1$ is the end point of band b, and $X_{ref}$ is the spectrum of the reference signal. $X_i$ (for i in [1,2]) are the spectra of left and right channel of the two-channel stereo audio signal 201. $X^*_{ref}$ and $X^*_I$ are the conjugate of $X_{ref}$ and $X_i$ respectively. The spectrum of the reference signal $X_{ref}$ is in the channel taken as reference channel. Normally, a full band ILD is used, where the number of bands b is 1.

The determiner 203 determines the time-scaling positions δ for left and right channel which maximize the cc(m, δ), cn(m, δ) or ca(m, δ).

The time scaler 207 time-scales left and right audio channel signals 201_1 and 201_2 with the corresponding time-scaling position δ, 205 determined by the determiner 203 to obtain the left and right time scaled audio channel signals 209_1 and 209_2 constituting the time-scaled 2-channel stereo audio signal 209.

In a fifth implementation form, the determiner 203 extracts spatial parameters from the multi-channel audio signal 201 and calculates at least one of the similarity measures which are cross-correlation cc(m, δ), normalized cross-correlation cn(m, δ) and cross average magnitude difference functions (cross-AMDF) ca(m, δ) according to one of the four preceding implementation forms described with respect to FIG. 2. The determiner 203 applies a constrained time-scaling (waveform-similarity-based synchronized overlap-add, WSOLA) to all channels and modifies the calculated similarity measures, i.e. cross-correlation cc(m, δ), normalized cross-correlation cn(m, δ) and/or cross average magnitude difference functions (cross-AMDF) ca(m, δ) in order to eliminate the waveforms which do not preserve at least one spatial cue.

Figure 6:
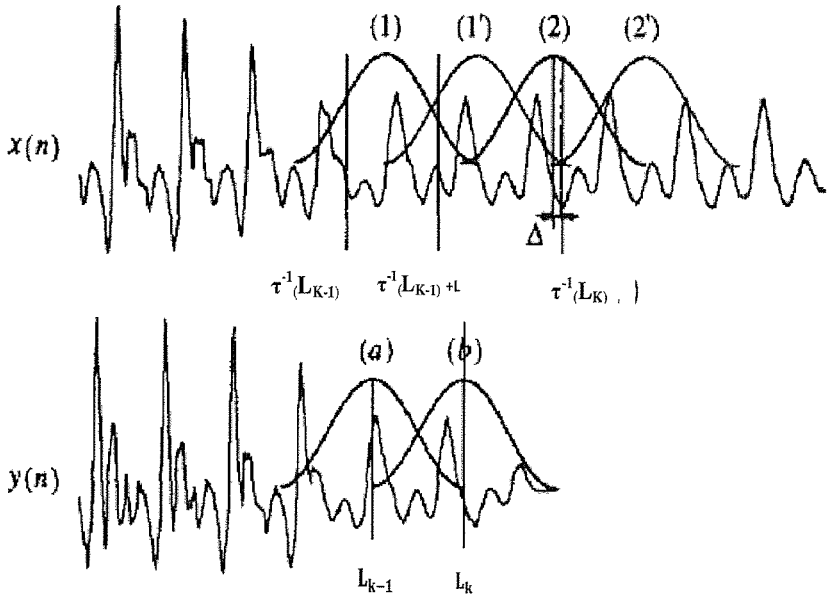
FIG. 6 shows a time diagram illustrating a constrained time-scaling as applied by the audio signal processing apparatus according to an implementation form.

The basic idea of WSOLA, as applied by the determiner 203, is to determine the ideal time-scaling position which produces a synthetic waveform y(n) that maintains maximal local similarity to the original waveform x(p) in corresponding neighbourhoods of related sample indices $n=\tau(p)$. It can be seen from FIG. 6 illustrating a WSOLA algorithm, that the index p of the original waveform can be obtained by $p=\tau^{-1}(n)$.

By choosing regularly spaced synthesis instants $L_k=k\cdot L$ and a symmetric window such that $$\sum_k \upsilon(n-k\cdot L)=1$$

The synthesis equation can be written as:

$$y(n)=\sum_k \upsilon(n-k\cdot L)\cdot x(n+\tau^{-1}(k\cdot L)-k\cdot L+\Delta_k)$$

Note that k represents here the index of synthesis instants. Proceeding in a left-to-right fashion, for a compression operation, it is assumed that segment (2) from FIG. 6 was the last segment that was excised from the input and added to the output at time instant $L_{k-1}=(k-1)\cdot L$, i.e. segment (a)=segment (2). WSOLA then needs to find a segment (b) that will overlap-add with (a) in a synchronized way and can be excised from the input around time instant $\tau^{-1}(k\cdot L)$, here $L_k=k\cdot L$. As (1') would overlap-add with (2)=(a) in a natural way to form a portion of the original input speech, WSOLA can select (b) such that it resembles (1') as closely as possible and is located within the prescribed tolerance interval $[-\Delta_{max},\Delta_{max}]$ around $\tau^{-1}(k\cdot L)$ in the input wave. The position of this best segment (3) is found by maximizing a similarity measure (such as the cross correlation or the cross-AMDF (Average Magnitude Difference Function)) between the sample sequence underlying (1') and the input speech. After overlap-adding (b) with (a), WSOLA proceeds to the next output segment, where (2') now plays the same role as (1') in the previous step.

The best segment m is determined by finding the value $\delta=\Delta_m$ that lies within a tolerance region $[-\Delta_{max},\Delta_{max}]$ around $\tau^{-1}(m\cdot L)$, and maximizes the chosen similarity measure. Similarity measures are as provided in equation (2), (3) and (4).

By applying the constrained time-scaling (WSOLA) to all channels, the determiner 203 validates the extracted δ. From equations (5), (1), (8), (6) according to the implementation form used for calculating the similarity values, the determiner 203 computes a list of j candidates for δ which may be ordered from the best cc, cn or ca to the worst cc, cn or ca. In a second step, the ICC and/or ITD are computed on the synthesized waveforms and if the ICC and/or ITD are not in a range around the original ICC and/or ITD, the candidate δ is eliminated from the list, and the following δ candidate is tested. If the ICC and/or ITD constraint are fulfilled, the δ is selected.

Inter channel Time Differences (ITD), Inter channel Level Differences (ILD) and Inter Channel Coherence/Inter channel Cross Correlation (ICC) are spatial information extracted by the determiner 203 from the multi-channel audio signal 201 as described in the following.

The determiner 203 extracts ILDs from the multi-channel audio signal 201 by using the equation (11).

Based on this information, the determiner 203 calculates M−1 spatial cues. Furthermore, the determiner 203 calculates for each channel i the Inter-channel Time Difference (ITD), which represents the delay between the channel signal i and the reference channel, from the multi-channel audio signal 201 based on the following equation $$ITD_i = \underset{d}{\operatorname{argmax}} \{IC_i(d)\} \tag{12}$$

With $IC_i(d)$ being the normalized cross-correlation defined as $$IC_i[d] = \frac{\sum_{n=0}^{N-1} x_{ref}[n]x_i[n-d]}{\sqrt{\sum_{n=0}^{N-1} x_{ref}^2[n] \sum_{n=0}^{N-1} x_i^2[n]}}, \tag{13}$$

$x_{ref}$ represents the reference signal and $x_i$ represents the channel signal i. The $ICC_i$ parameter is defined as $ICC_i = IC_i$ [d].

The time scaler 207 time-scales each of the M audio channel signals 201_1, 201_2, . . . , 201_M with the corresponding time-scaling position δ, 205 determined by the determiner 203 to obtain the M time scaled audio channel signals 209_1, 209_2, . . . , 209_M constituting the time-scaled multi-channel audio signal 209.

In a first variant of the fourth implementation form and in a first variant of the fifth implementation form, $X_{ref}$ is the spectrum of a mono down-mix signal, which is the average of all M channels. M spatial cues are calculated in the determiner 203. The advantage of using a down-mix signal as a reference for a multi-channel audio signal is to avoid using a silent signal as reference signal. Indeed the down-mix represents an average of the energy of all the channels and is hence less subject to be silent.

In a sixth implementation form, the determiner 203 validates the extracted δ according to the fifth implementation form. However, if no δ fulfils the constraint with respect to the constrained time-scaling (WSOLA), the δ with the maximum cc, cn or ca will be chosen.

The time scaler 207 time-scales each of the M audio channel signals 201_1, 201_2, . . . , 201_M with the corresponding time-scaling position δ, 205 determined by the determiner 203 to obtain the M time scaled audio channel signals 209_1, 209_2, . . . , 209_M constituting the time-scaled multi-channel audio signal 209.

Figure 3:
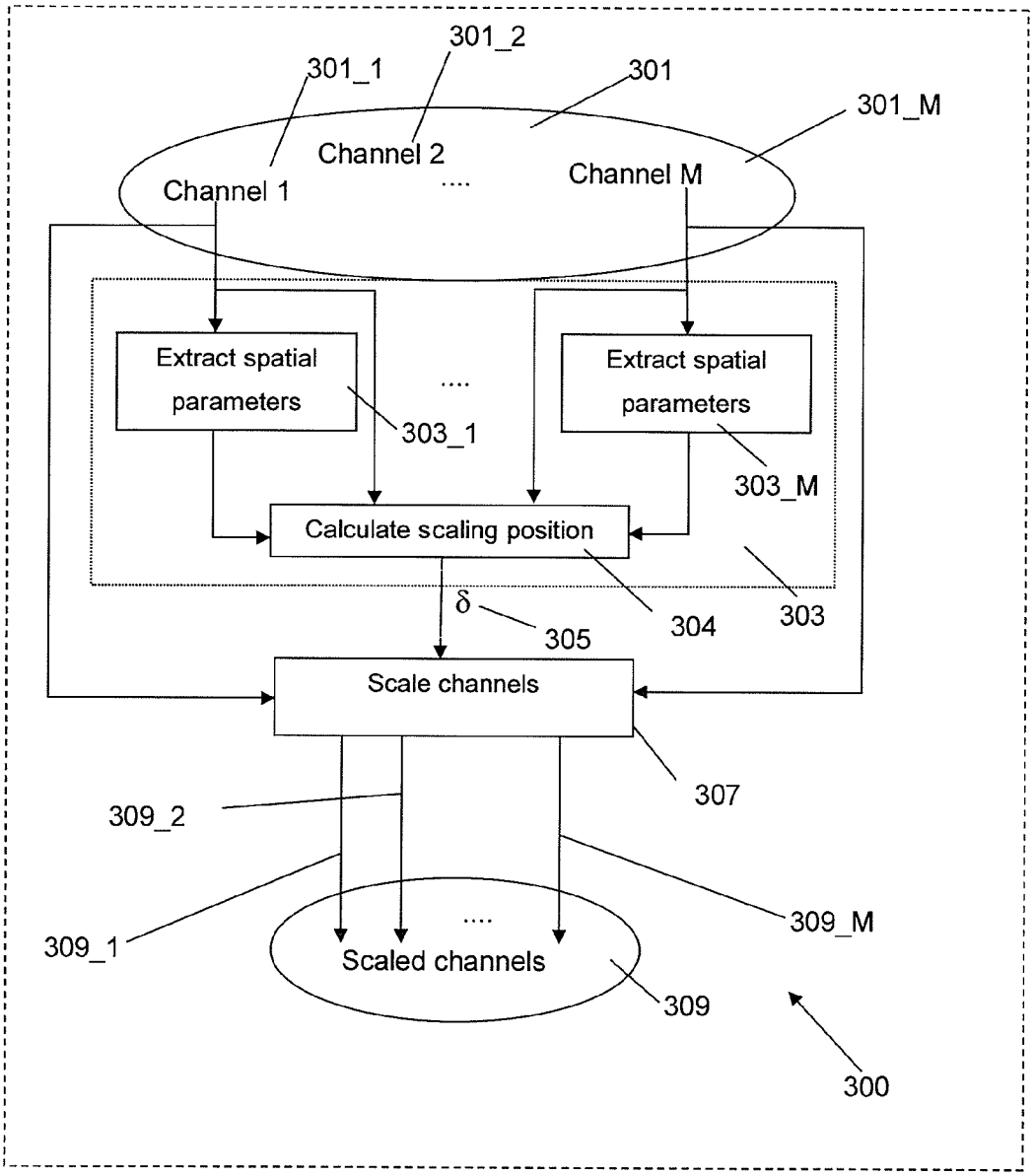
FIG. 3 shows a block diagram of an audio signal processing apparatus according to an implementation form.

FIG. 3 shows a block diagram of an audio signal processing apparatus 300 for processing a multi-channel audio signal 301 which comprises a plurality of audio channel signals 301_1, 301_2, . . . , 301_M according to an implementation form. The audio signal processing apparatus 300 comprises a determiner 303 and a time scaler 307. The determiner 303 is configured to determine a time-scaling position δ, 305 using the plurality of audio channel signals 301_1, 301_2, . . . , 301_M. The time scaler 307 is configured to time-scale each audio channel signal of the plurality of audio channel signals 301_1, 301_2, . . . , 301_M according to the time-scaling position δ, 305 to obtain a plurality of time scaled audio channel signals 309_1, 309_2, . . . , 309_M which constitute a time scaled multi-channel audio signal 309. The determiner 303 has M inputs for receiving the plurality of M audio channel signals 301_1, 301_2, . . . , 301_M and one output for providing the time-scaling position 205. The time scaler 307 has M inputs for receiving the plurality of M audio channel signals 301_1, 301_2, . . . , 301_M and one input to receive the time-scaling position 305. The time scaler 307 has M outputs for providing the plurality of M time scaled audio channel signals 309_1, 309_2, . . . , 309_M which constitute the time scaled multi-channel audio signal 309.

The determiner 303 comprises M extracting units 303_1, 303_2, . . . , 303_M which are configured to extract the spatial parameters and one calculating unit 304 which is configured to calculate the scaling position δ, 305.

In a first implementation form of the audio signal processing apparatus 300, each of the M extracting units 303_1, 303_2, . . . , 303_M extracts the spatial parameters for each of the plurality of M audio channel signals 301_1, 301_2, . . . , 301_M. The calculating unit 304 computes the cross-correlation cc(m, δ) normalized cross-correlation cn(m, δ) and/or cross average magnitude difference functions (cross-AMDF) ca(m, δ) for the plurality of M audio channel signals 301_1, 301_2, . . . , 301_M according to the first implementation form of the audio signal processing apparatus 200 described with respect to FIG. 2.

The calculating unit 304 calculates the best segment m by finding the value $\delta=\Delta_m$ that lies within a tolerance region $[-\Delta_{max},\Delta_{max}]$ around a time interval $\tau^{-1}(m \cdot L)$, and maximizes the chosen similarity measure according to the first implementation form of the audio signal processing apparatus 200 described with respect to FIG. 2.

In a second implementation form of the audio signal processing apparatus 300, the multi-channel audio signal 301 is a 2-channel stereo audio signal which comprises left and right audio channel signals 301_1 and 301_2. The determiner 303 comprises two extracting units 303_1, 303_2 which are configured to extract the spatial parameters from the left and right audio channel signals 301_1 and 301_2 and one calculating unit 304 which is configured to calculate the scaling position □, 305.

Each of the left and right extracting units 303_1 and 303_2 extracts ILD and/or ITD and/or ICC.

The calculating unit 304 computes the cross-correlation cc(m, δ), normalized cross-correlation cn(m, δ) and/or cross average magnitude difference functions (cross-AMDF) ca(m, δ) for the left and right audio channel signals 201_1 and 201_2, respectively, according to the second implementation form of the audio signal processing apparatus 200 described with respect to FIG. 2.

The calculating unit 304 calculates the best segment m by finding the value $\delta=\Delta_m$ that lies within a tolerance region $[-\Delta_{max},\Delta_{max}]$ around a time interval $\tau^{-1}(m \cdot L)$, and maximizes the chosen similarity measure according to the second implementation form of the audio signal processing apparatus 200 described with respect to FIG. 2.

In a third implementation form of the audio signal processing apparatus 300, each of the M extracting units 303_1, 303_2, . . . , 303_M extracts the spatial parameters for each of the plurality of M audio channel signals 301_1, 301_2, . . . , 301_M. The calculating unit 304 computes the cross-correlation cc(m, δ) normalized cross-correlation cn(m, δ) and/or cross average magnitude difference functions (cross-AMDF) ca(m, δ) for the plurality of M audio channel signals 301_1, 301_2, . . . , 301_M according to the third implementation form of the audio signal processing apparatus 200 described with respect to FIG. 2.

The calculating unit 304 determines the time-scaling positions δ for each channel 1 thru M which maximize the cc(m, δ), cn(m, δ) or ca(m, δ) as described above with respect to the third implementation form.

In a fourth implementation form of the audio signal processing apparatus 300, the multi-channel audio signal 301 is a 2-channel stereo audio signal which comprises left and right audio channel signals 301_1 and 301_2. The determiner 303 comprises two extracting units 303_1, 303_2 which are configured to extract the spatial parameters from the left and right audio channel signals 301_1 and 301_2 and one calculating unit 304 which is configured to calculate the scaling position □, 305.

The calculating unit 304 determines the time-scaling positions δ for each channel 1 thru M which maximize the cc(m, δ), cn(m, δ) or ca(m, δ) as described above with respect to the fourth implementation form.

In a fifth implementation form of the audio signal processing apparatus 300, each of the M extracting units 303_1, 303_2, . . . , 303_M extracts the spatial parameters for each of the plurality of M audio channel signals 301_1, 301_2, . . . , 301_M. The calculating unit 304 computes the cross-correlation cc(m, δ), normalized cross-correlation cn(m, δ) and/or cross average magnitude difference functions (cross-AMDF) ca(m, δ) for the plurality of M audio channel signals 301_1, 301_2, . . . , 301_M according to the fifth implementation form of the audio signal processing apparatus 200 described with respect to FIG. 2.

The calculating unit 304 determines the time-scaling positions δ for each channel 1 thru M which maximize the cc(m, δ), cn(m, δ) or ca(m, δ) as described above with respect to the fifth implementation form.

In a sixth implementation form of the audio signal processing apparatus 300, each of the M extracting units 303_1, 303_2, . . . , 303_M extracts the spatial parameters for each of the plurality of M audio channel signals 301_1, 301_2, . . . , 301_M. The calculating unit 304 computes the cross-correlation cc(m, δ) normalized cross-correlation cn(m, δ) and/or cross average magnitude difference functions (cross-AMDF) ca(m, δ) for the plurality of M audio channel signals 301_1, 301_2, . . . , 301_M according to the sixth implementation form of the audio signal processing apparatus 200 described with respect to FIG. 2.

The calculating unit 304 determines the time-scaling positions δ for each channel 1 thru M which maximize the cc(m, δ), cn(m, δ) or ca(m, δ) as described above with respect to the sixth implementation form.

Figure 4:
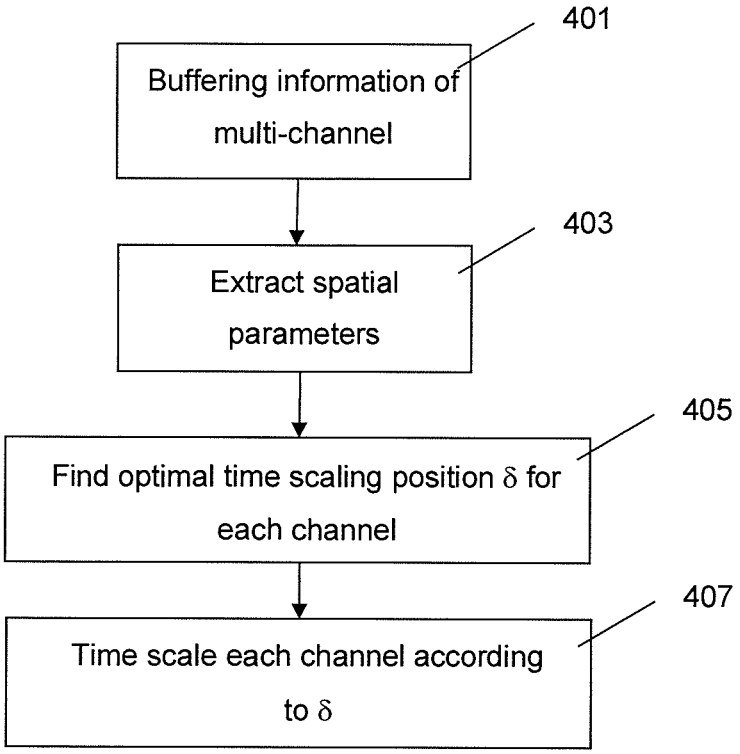
FIG. 4 shows a block diagram of a method for processing a multi-channel audio signal according to an implementation form.

FIG. 4 shows a block diagram of a method for processing a multi-channel audio signal according to an implementation form. The method comprises buffering 401 the information of multi-channel; extracting 403 the spatial parameters; finding 405 the optimal time-scaling position δ for each channel; and time-scaling 407 each channel according to the optimal time-scaling position □. The buffering 401 is related to the multi-channel audio signal 201, 301 as described with respect to FIGS. 2 and 3. For buffering a memory cell or a RAM or another hardware-based buffer is used. The extracting 403 is related to the M extracting units 303_1, 303_2, . . . , 303_M which are configured to extract the spatial parameters as described with respect to FIG. 3. The finding 405 the optimal time-scaling position δ for each channel is related to the calculating unit 304 which is configured to calculate the scaling position δ, 305, as described with respect to FIG. 3. The time-scaling 407 is related to the scaling unit 307 as described with respect to FIG. 3. Each of the method steps 401, 403, 405 and 407 is configured to perform the functionality of the respective unit as described with respect to FIG. 3.

Figure 5:
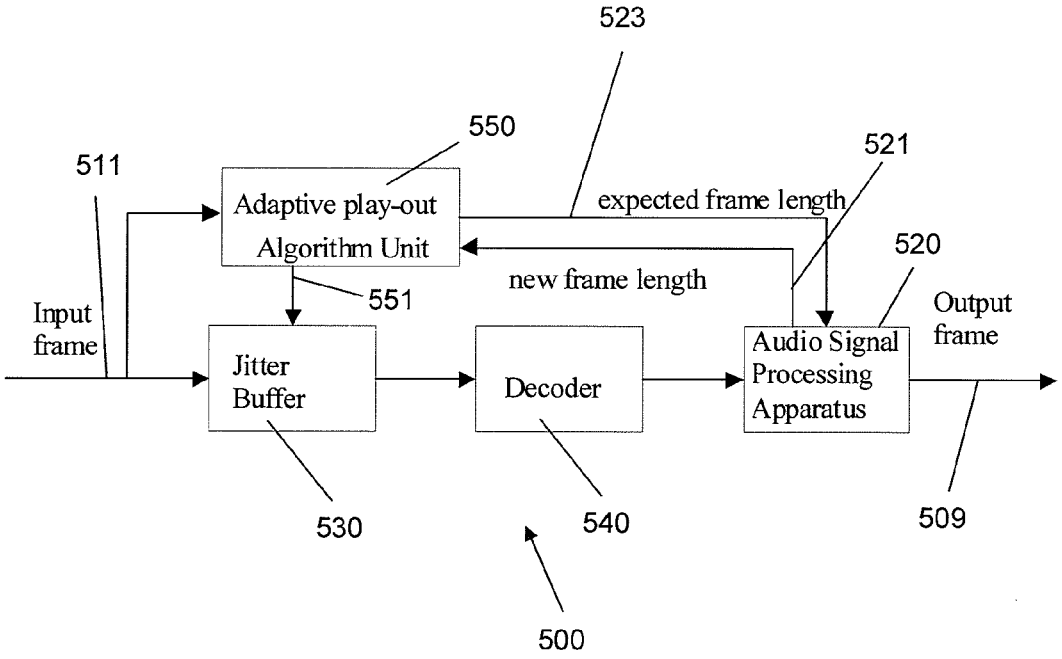
FIG. 5 shows a block diagram of a jitter buffer management device according to an implementation form.

FIG. 5 shows a block diagram of a jitter buffer management device 500 according to an implementation form. The jitter buffer management device 500 comprises a jitter buffer 530, a decoder 540, an adaptive playout algorithm unit 550 and an audio signal processing apparatus 520. The jitter buffer 530 comprises a data input to receive an input frame 511 and a control input to receive a jitter control signal 551. The jitter buffer 530 comprises a data output to provide a buffered input frame to the decoder 540. The decoder 540 comprises a data input to receive the buffered input frame from the jitter buffer 530 and a data output to provide a decoded frame to the audio signal processing apparatus 520. The audio signal processing apparatus 520 comprises a data input to receive the decoded frame from the decoder 540 and a data output to provide an output frame 509. The audio signal processing apparatus 520 comprises a control input to receive an expected frame length 523 from the adaptive playout algorithm unit 550 and a control output to provide a new frame length 521 to the adaptive playout algorithm unit 550. The adaptive playout algorithm unit 550 comprises a data input to receive the input frame 511, a control input to receive the new frame length 521 from the audio signal processing apparatus 520. The adaptive playout algorithm unit 550 comprises a first control output to provide the expected frame length 523 to the audio signal processing apparatus 520 and a second control output to provide the jitter control signal 551 to the jitter buffer 530.

In Voice over IP applications, the speech signal is first compressed using a speech encoder. In order to maintain the interoperability, voice over IP systems are usually built on top of open speech codec. They can be standardized, for instance in ITU-T or 3GPP codec (several standardized speech codec are used for VoIP: G.711, G.722, G.729, G.723.1, AMR-WB) or proprietary format (Speex, Silk, CELT). In order to decode the encoded speech signal, the decoder 540 is utilized. In implementation forms, the decoder is configured to apply one of the standardized speech codecs G.711, G.722, G.729, G.723.1, AMR-WB or one of the proprietary speech codecs Speex, Silk, CELT.

The encoded speech signal is packetized and transmitted in IP packets. Packets will encounter variable network delays in VoIP, so they arrive at irregular intervals. In order to smooth such jitter, a jitter buffer management mechanism is usually required at the receiver: the received packets are buffered for a while and played out sequentially at scheduled time. In implementation forms, the jitter buffer 530 is configured to buffer the received packets, i.e. the input frames 511 according to a jitter control signal 551 provided from the adaptive playout algorithm unit 550.

If the play-out time can be adjusted for each packet, then time scale modification is required to ensure continuous play-out of voice data at a sound card. The audio signal processing apparatus 520 is configured to provide time scale modification to ensure continuous play-out of voice data at the sound card. As the delay is not a constant delay, the audio signal processing apparatus 520 is configured to stretch or compress the duration of a given received packet. In an implementation form, the audio signal processing apparatus 520 is configured to use a WSOLA technology for the time-scaling. The audio signal processing apparatus 520 corresponds to the audio signal processing apparatus 200 as described with respect to FIG. 2 or to the audio signal processing apparatus 300 as described with respect to FIG. 3.

In an implementation form, the jitter buffer management device 500 is configured to manage stereo or multi-channel VoIP communication.

In an implementation form, the decoder 540 comprises a multi-channel codec applying a specific multi-channel audio coding scheme, in particular a parametric spatial audio coding scheme.

In an implementation form, the decoder 540 is based on a mono codec which operates in dual/multi mono mode, i.e. one mono encoder/decoder is used for each channel. Using an independent application of the time-scaling algorithm for each channel can lead to quality degradation (especially of the spatial sound image) as the independent time-scaling will not guarantee that the spatial cues are preserved. Therefore, the audio signal processing apparatus 520, corresponding to the audio signal processing apparatus 200 as described with respect to FIG. 2 or to the audio signal processing apparatus 300 as described with respect to FIG. 3, is configured to preserve the spatial cues such that the jitter buffer management device 500 shows no performance degradation with respect to the spatial sound image.

In the audio/video broadcast and post-production application, it may be necessary to play back the video at a different rate than the source material was recorded, which will result in a pitch-shifted version of the accompanying audio signal. This commonly occurs during the frame rate conversion process when content at the film rate of 24 frames per second is played back at a faster rate for transferring to systems with a playback rate of 25 frames per second. Time-scaling performed by the audio signal processing apparatus 520 maintains synchronization between the audio and video while preserving the pitch of the original source material.

Independent application of the time-scaling algorithm would lead to modification of the speaker's position. The jitter buffer management device 500 preserves the most important spatial cues which are ITD, ILD and ICC and others. The spatial cues are used to constrain the time-scaling algorithm. Hence, even when the time-scaling is used to stretch or compress the multi-channel audio signal, the spatial sound image is not modified.

The jitter buffer management device 500 is configured to preserve the spatial cues during multi-channel time-scaling processing. In an implementation form, the audio signal processing apparatus 520 applies a method for processing a multi-channel audio signal carrying a plurality of audio channel signals, wherein the method comprises the steps: extracting the spatial information, such as ITD (Inter channel Time Differences), ILD (Inter channel Level Differences) or ICC (Inter Channel Coherence/Inter channel Cross Correlation), from the multi-channel signals which are not time scaled; and applying a constrained time-scaling algorithm to each channel ensuring that the spatial cues are preserved.

In an implementation form, the audio signal processing apparatus 520 applies a method for processing a multi-channel audio signal carrying a plurality of audio channel signals, wherein the method comprises the steps: extracting the spatial parameters from the multi-channel signal; applying a constrained time-scaling (WSOLA) to all channels; and modifying the similarity measures, i.e. cross-correlation, normalized cross-correlation or cross-AMDF, in order to eliminate the waveforms which do not preserve at least one spatial cue. In a variant of this implementation form, the similarity measures are modified in order to eliminate the waveforms which do not preserve all the spatial cues.

In case of multi-channel VoIP applications, the data from all the channels is encapsulated into one packet or different packets, when they are transmitted from the sender to the receiver. The receiver according to an implementation form, comprises a jitter buffer management device 500 as depicted in FIG. 5. If all the channels are put into one packet, they have the same jitter. If all the channels are packeted into different packets, they usually have different jitter for each channel, and the packets arrive in different order. In order to compensate the jitter and align all the channels, a maximum delay is set. If the packet comes too late and exceeds the maximum delay, the data will be considered as lost and a packet loss concealment algorithm is used. In the specific case where the channels are transmitted in different packets, a frame index is used together with the channel index in order to make sure that the decoder 540 can reorder the packets for each channel independently.

In the audio/video broadcast and post-production application, if the time scale position of each channel is the same, ITD can be maintained. If the energy of each channel is not changed before and after the time-scaling, the ILD can be kept. In an implementation form, the jitter buffer management device 500 does not change the energy of each channel before and after the time-scaling.

In an implementation form, the jitter buffer management device 500 is used in applications where the multi-channel decoder is based on the operation of several mono decoders, i.e. dual mono for the stereo case, or where the joint stereo codec switches between the dual mono model and the mono/stereo model according to the input stereo signals. In an implementation form, the jitter buffer management device 500 is used in audio/video broadcast and/or post-production applications.

What is claimed is:

1. A method for processing a multi-channel audio signal, the multi-channel audio signal carrying a plurality of audio channel signals, the method comprising:

determining a time-scaling position using the plurality of audio channel signals;

time-scaling each audio channel signal of the plurality of audio channel signals according to the time-scaling position to obtain a plurality of time scaled audio channel signals;

extracting a first set of spatial cue parameters from the plurality of audio channel signals, the first set of spatial cue parameters relating to a difference measure of a difference between the plurality of audio channel signals and a reference audio channel signal derived from at least one of the plurality of audio channel signals;

extracting a second set of spatial cue parameters from the plurality of time scaled audio channel signals, the second set of spatial cue parameters relating to the same type of difference measure as the first set of spatial cue parameters relates to, wherein the second set of spatial cue parameters relates to a difference between the plurality of time scaled audio channel signals and a reference time scaled audio channel signal derived from at least one of the plurality of time scaled audio channel signals; and determining whether the second set of spatial cue parameters fulfills with regard to the first set of spatial cue parameters a quality criterion.

2. The method of claim 1, wherein extracting the first set of spatial cue parameters comprises correlating an audio channel signal of the plurality of audio channel signals with the reference audio channel signal; and wherein extracting the second set of spatial cue parameters comprises correlating a time scaled audio channel signal of the plurality of the time scaled audio channel signals with the reference time scaled audio channel signal.

3. The method of claim 2, wherein the respective set of spatial cue parameters comprises one of the following parameters:

Inter Channel Time Difference (ITD),
Inter Channel Level Differences (ILD),
Inter Channel Coherence (ICC), or
Inter Channel Cross Correlation (IC).

4. The method of claim 1, comprising the following if the extracted second set of spatial cue parameters does not fulfill the quality criterion:

time-scaling each audio channel signal of the plurality of audio channel signals according to a further time-scaling position to obtain a further plurality of time scaled audio channel signals, wherein the further time-scaling position is determined using the plurality of audio channel signals;

extracting a third set of spatial cue parameters from the further plurality of time scaled audio channel signals, the third set of spatial cue parameters relating to the same type of difference measure as the first set of spatial cue parameters relates to, wherein the third set of spatial cue parameters relates to a difference between the further plurality of time scaled audio channel signals and a further reference time scaled audio channel signal derived from at least one of the further plurality of time scaled audio channel signals;

determining whether the third set of spatial cue parameters fulfills with regard to the first set of spatial cue parameters the quality criterion; and outputting the further plurality of time scaled audio channel signals if the third set of spatial cue parameters fulfills the quality criterion.

5. The method of claim 4, wherein the respective set of spatial cue parameters comprises one of the following parameters:

Inter Channel Time Difference (ITD),
Inter Channel Level Differences (ILD),
Inter Channel Coherence (ICC), or
Inter Channel Cross Correlation (IC).

6. The method of claim 1, wherein the respective set of spatial cue parameters fulfils with regard to the first set of spatial cue parameters the quality criterion if the respective set of spatial cue parameters is within a spatial cue parameter range.

7. The method of claim 6, wherein the respective set of spatial cue parameters comprises one of the following parameters:

Inter Channel Time Difference (ITD),
Inter Channel Level Differences (ILD),
Inter Channel Coherence (ICC), or
Inter Channel Cross Correlation (IC).

8. The method of claim 1, wherein determining the time-scaling position comprises:

for each of the plurality of audio channel signals, determining a channel cross-correlation function having candidate time-scaling positions as parameter;

determining a cumulated cross-correlation function by cumulating the plurality of channel cross-correlation functions depending on the candidate time-scaling positions; and selecting the time-scaling position which is associated with the greatest cumulated cross-correlation value of the cumulated cross-correlation function to obtain the time-scaling position.

9. The method of claim 8, wherein the respective cross-correlation function is one of the following cross-correlation functions:

Cross-correlation function, or
Normalized cross-correlation function, or
Cross Average Magnitude Difference Function (Cross-AMDF).

10. The method of claim 8, further comprising:

for each audio channel signal of the plurality of audio channel signals, determining a weighting factor from a spatial cue parameter, wherein the spatial cue parameter is extracted based on the audio channel signal and a reference audio channel signal derived from at least one of the plurality of audio channel signals, and wherein the spatial cue parameter is in particular an Inter Channel Level Difference; and individually weighting each channel cross-correlation function with the weighting factor determined for the audio channel signal.

11. The method of claim 1, further comprising buffering the plurality of audio channel signals prior to time-scaling each audio channel signal of the plurality of audio channel signals.

12. The method of claim 1, wherein time-scaling comprises overlapping and adding audio channel signal portions of the same audio channel signal.

13. The method of claim 1, wherein the multi-channel audio signal comprises a plurality of encoded audio channel signals, and wherein the method comprises:

decoding the plurality of encoded audio channel signals to obtain the plurality of audio channel signals.

14. The method of claim 1, wherein the respective set of spatial cue parameters comprises one of the following parameters:

Inter Channel Time Difference (ITD),
Inter Channel Level Differences (ILD),
Inter Channel Coherence (ICC), or
Inter Channel Cross Correlation (IC).

15. An audio signal processing apparatus for processing a multi-channel audio signal, the multi-channel audio signal comprising a plurality of audio channel signals, the audio signal processing apparatus comprising:

a determiner adapted to determine a time-scaling position using the plurality of audio channel signals; and a time scaler adapted to time scale each audio channel signal of the plurality of audio channel signals according to the time-scaling position to obtain a plurality of time scaled audio channel signals;

an extractor adapted to extract a first set of spatial cue parameters from the plurality of audio channel signals, the first set of spatial cue parameters relating to a difference measure of a difference between the plurality of audio channel signals and a reference audio channel signal derived from at least one of the plurality of audio channel signals, wherein the extractor is further adapted to extract a second set of spatial cue parameters from the plurality of time scaled audio channel signals, the second set of spatial cue parameters relating to the same type of difference measure as the first set of spatial cue parameters relates to, wherein the second set of spatial cue parameters relates to a difference between the plurality of time scaled audio channel signals and a reference time scaled audio channel signal derived from at least one of the plurality of time scaled audio channel signals; and a processor adapted to determine whether the second set of spatial cue parameters fulfills with regard to the first set of spatial cue parameters a quality criterion.

16. The audio signal processing apparatus of claim 15, wherein the multi-channel audio signal comprises a plurality of encoded audio channel signals, and wherein the audio signal processing apparatus comprises:

a decoder adapted to decode the plurality of encoded audio channel signals to obtain the plurality of audio channel signals.

17. The audio signal processing apparatus of claim 15, wherein the determiner is adapted for each of the plurality of audio channel signals, to determine a channelcross-correlation function in dependency on candidate time-scaling positions, to determine a cumulated cross-correlation function by cumulating the plurality of channel cross-correlation functions depending on the candidate time-scaling positions, and to select the time-scaling position which is associated with the greatest cumulated cross-correlation value of the cumulated cross-correlation function to obtain the time-scaling position.

18. An apparatus for processing a multi-channel audio signal, the multi-channel audio signal comprising a plurality of audio channel signals, the apparatus comprising:

a processor; and memory coupled to the processor comprising instructions that, when executed by the processor, cause the apparatus to:

determine a time-scaling position using the plurality of audio channel signals, time-scale each audio channel signal of the plurality of audio channel signals according to the time-scaling position to obtain a plurality of time scaled audio channel signals, an extractor adapted to extract a first set of spatial cue parameters from the plurality of audio channel signals, the first set of spatial cue parameters relating to a difference measure of a difference between the plurality of audio channel signals and a reference audio channel signal derived from at least one of the plurality of audio channel signals, wherein the extractor is further adapted to extract a second set of spatial cue parameters from the plurality of time scaled audio channel signals, the second set of spatial cue parameters relating to the same type of difference measure as the first set of spatial cue parameters relates to, wherein the second set of spatial cue parameters relates to a difference between the plurality of time scaled audio channel signals and a reference time scaled audio channel signal derived from at least one of the plurality of time scaled audio channel signals; and determine whether the second set of spatial cue parameters fulfills with regard to the first set of spatial cue parameters a quality criterion.

19. The apparatus for processing a multi-channel audio signal according to claim 18, further comprising instructions that, when executed by the processor, cause the apparatus to:

for each of the plurality of audio channel signals, determine a channel cross-correlation function in dependency on candidate time-scaling positions, determine a cumulated cross-correlation function by cumulating the plurality of channel cross-correlation functions depending on the candidate time-scaling positions, and select the time-scaling position which is associated with the greatest cumulated cross-correlation value of the cumulated cross-correlation function to obtain the time-scaling position.

* * * * *